United States Patent [19]

Dokoupil et al.

[11] 4,092,757

[45] June 6, 1978

[54] APPARATUS FOR THE IDENTIFICATION OF SIZE NUMBERS OF RIGHT AND LEFT LASTS

[75] Inventors: Ludvik Dokoupil; Oldrich Hrouda, both of Gottwaldov; Josef Zila, Otrokovice, all of Czechoslovakia

[73] Assignee: Zavody presneho strojirenstvi, narodni podnik, Gottwaldov, Czechoslovakia

[21] Appl. No.: 798,562

[22] Filed: May 13, 1977

[30] Foreign Application Priority Data

May 13, 1976 Czechoslovakia ..... 3183/76

[51] Int. Cl.[2] ..... A43D 3/00

[52] U.S. Cl. ..... 12/127

[58] Field of Search ..... 12/125, 126, 127

[56] References Cited

U.S. PATENT DOCUMENTS

| | | | |
|---|---|---|---|
| 2,263,488 | 11/1941 | Cross | 12/127 |
| 3,077,619 | 2/1963 | Hidden et al. | 12/127 |

*Primary Examiner*—Patrick D. Lawson

[57] ABSTRACT

Size numbers of shoe lasts fixed on heel supports on shoe manufacturing machines are determined by electrical circuits comprising photocells which check the distance between the toe and heel of the last, said electrical circuit controlling the position of form plates for the adjustment of elements which work upon shoes on the shoe manufacturing machines.

5 Claims, 2 Drawing Figures

APPARATUS FOR THE IDENTIFICATION OF SIZE NUMBERS OF RIGHT AND LEFT LASTS

BACKGROUND OF THE INVENTION

This invention relates to a mechanism for the identification of the size numbers of right and left shoe lasts provided with last locating means such as a central bore in the heel part for a pin of a heel support of a shoe making machine.

Identification elements are sometimes used for automatic identification of the size numbers of right and left shoes, such identification elements being arranged on a strap piece on the last, different cuts, recesses and curves provided in the strap piece, determining the respective parameters of the last. Other known identification elements have a strap piece with a bolt above or below the supporting plane of the last, the bolt having either a different height or is provided with an opening of a different depth. In accordance therewith the differences in height or depth are detected and adjustments of the working elements of shoe machines are made by means of linkage mechanisms. Both these known arrangements are relatively demanding on tolerances of manufacture, and are exposed to damage and therefore are not very advantageous for modern shoe manufacture.

SUMMARY OF THE INVENTION

It is an object of the invention to provide an arrangement for the identification of the size numbers of right and left shoe lasts for shoe making machines, such arrangement requiring a minimum of special adjustments of the lasts.

It is another object of the invention to perform this identification automatically, and automatically to adjust working elements of the shoe making machine according to the size of a right or left shoe last.

In a preferred embodiment of the invention, the arrangement for identification of size numbers of right and left shoe lasts comprises two couples of light sources with photocells arranged on a support which is slidable in the direction of the longitudinal axis of the shoe last by means of a piston rod of a hydraulic cylinder fixed on the frame of the shoe making machine. The cylinder is controlled by an electromagnetic control slide valve with an electrical control relay connected to the electrical circuit of the light sources with the photocells, an electrical relay of an electromagnetic slide valve of an auxiliary hydraulic cylinder also being connected to this electrical circuit. The take-along piston rod of the auxiliary hydraulic cylinder is connected with slidable form plates for adjusting ironing devices of the shoe making machine. The electric circuit of the light sources and photocells is connected to an electrical relay of an electromagnetic valve of a setting cylinder, the piston rod of which is connected to a support for the toe part of the shoe last so as to adjust the position of such support in a direction generally transverse to the longitudinal axis of the shoe last.

The advantages of the arrangement according to this invention are that it automatically identifies the size numbers of right or left shoe lasts on a shoe making machine. Any special adjustment of the shoe lasts is eliminated and the possibility of erroneous identification as a result of damage to the identification elements is minimized.

DESCRIPTION OF THE DRAWINGS

An examplary embodiment of an arrangement for identification of size numbers or right and left shoe lasts is shown in the attached drawings, in which.

DESCRIPTION OF THE PREFERRED EMBODIMENT

Figure 1:
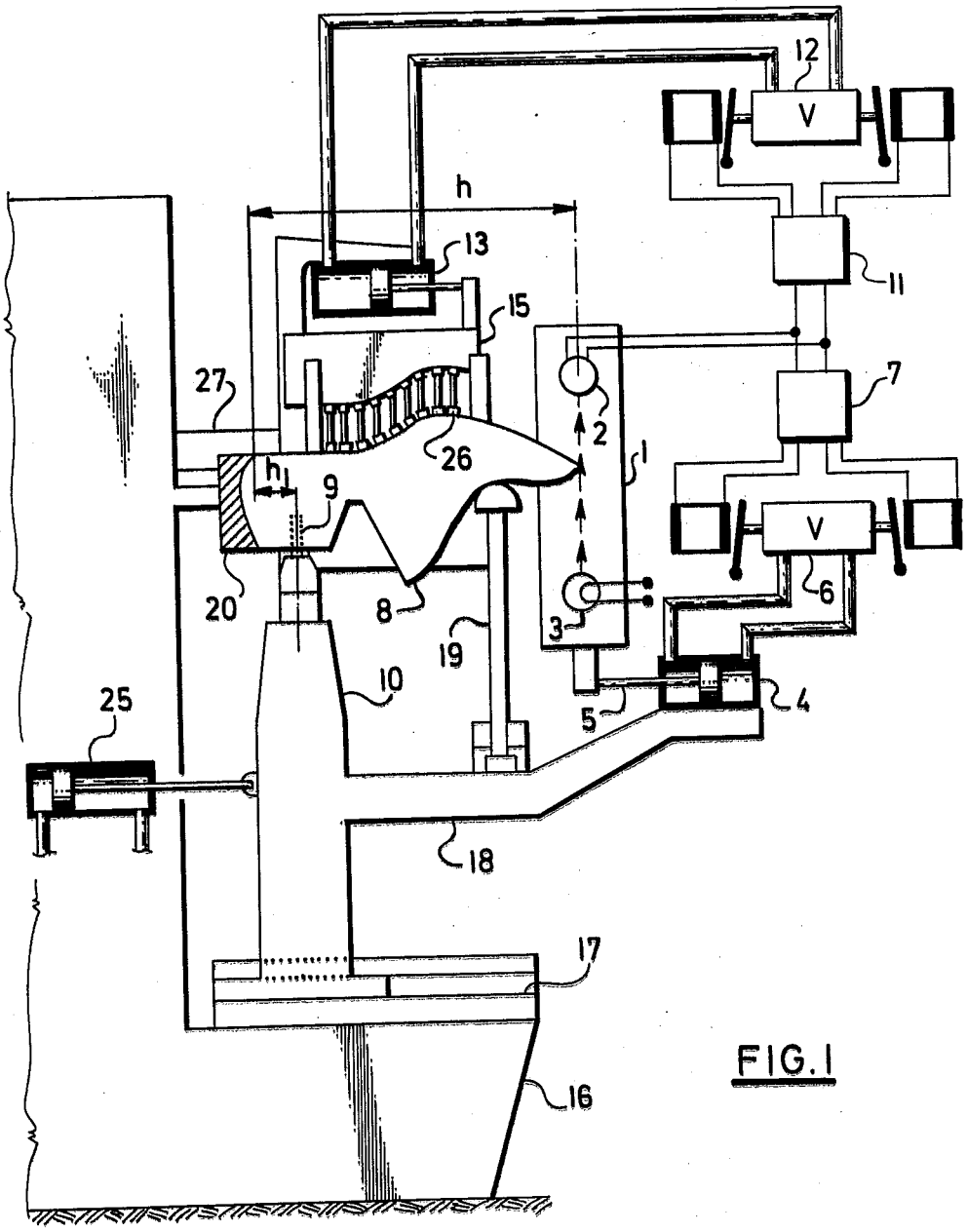
FIG. 1 is a diagrammatic side view of the whole arrangement with certain of the parts in section.

A guide 17 supports an adjustable heel support 10 provided with a side arm 18. Supported on arm 18 is a support 19 for the toe part of a shoe last 8, support 19 being slidably mounted on arm 18 for selective reverse adjustment in a direction normal to the paper in FIG. 1. A hydraulic control cylinder 4 is also mounted on arm 8, the support 10, the arm 8, support 19, and cylinder 4 being mounted on the frame 16 of a shoe making machine. The heel support 10 is provided with a pin 9 which enters a bore in the last for centering a left or right shoe last 8 with the stretched shoe upper on the machine. As noted, the heel part of the shoe last 8 has a centering bore for the pin 9, and the heel part of the last rests against a heel mold 20 while its toe part rests upon a support 19 for the toe part.

Figure 2:
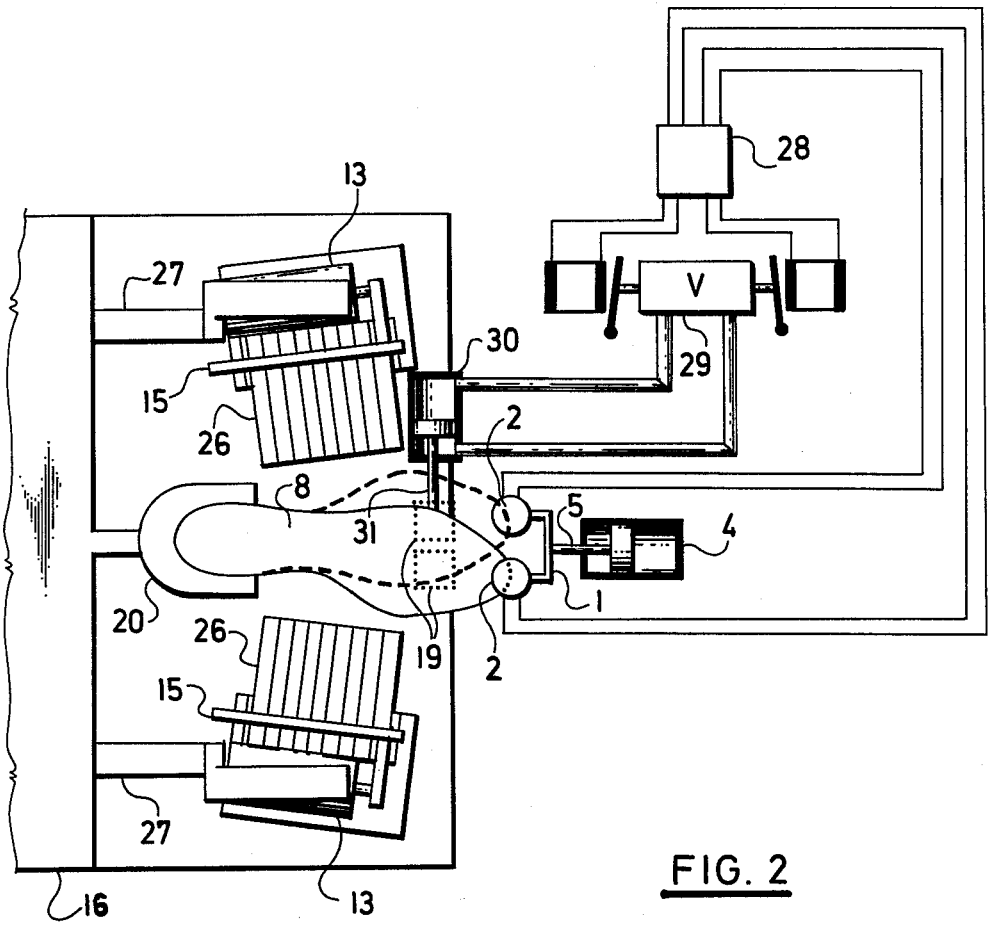
FIG. 2 is a top view of the arrangement.

The heel support 10 is brought from its rest (left in FIG. 1) position to the right into its working position shown in FIG. 1 by a setting cylinder 25. Ironing devices 26 on supports 27 are provided on both sides (FIG. 2) of the shoe last 8 at the level of its shank part. Identification elements are arranged on a supporting yoke 1, said identification elements comprising two sets each composed of a light source 3 and a photocell 2. The supporting yoke 1 is firmly connected to a piston rod 5 of a hydraulic control cylinder 4. Both sets of identification elements 2, 3 are arranged side by side at a distance corresponding to the difference of the deviation of the toe part of a right shoe last from a left shoe last. The working spaces of the hydraulic control cylinder 4 are connected with an electromagnetic control slide valve 6 which is controlled by an electric control relay 7, such relay in turn being connected to the electrical circuit of light sources 3 and photocells 2.

The axis of the centering bore of the shoe last for all last sizes lies at the same distance $h_1$ from the extremity of the heel curve of the shoe last, whereas the length $h$ of the shoe last 8 varies with its size number. An electrical relay 11, which controls an electromagnetic slide valve 12, is also connected to the electrical circuit of the light sources 3 and photocells 2, said slide valve 12 controlling the supply of liquid to auxiliary hydraulic cylinders 13 with piston rods 14 fixed to slidable form plates 15 which adjust the position of ironing devices 26. An electrical relay 28 controls an electromagnetic valve 29, which in turn controls the supply of pressure medium to a setting cylinder 30, is also connected to the electrical circuit of light sources 3 and photocells 2, the piston rod 31 of setting cylinder 30 being connected to the support 19 for the toe part of the shoe last 8 so as to adjust such support in reverse directions generally transverse to the longitudinal axis of the shoe last.

The apparatus according to this invention operates as follows: The identification elements, in the described embodiment two sets of light sources 3 and photocells 2 fixed on a supporting yoke 1, are shifted by the action of the hydraulic control cylinder 4 until a light beam from one of the light sources 3 is interrupted by the toe part of a right or left shoe last. Depending upon which of the light beams has been interrupted, fluid pressure medium is admitted to the setting cylinder 30 so that the support 19 of the toe part is shifted below a right or left shoe last as required, the supply of the pressure liquid being controlled by the electromagnetic valve 29, which is controlled in turn by the electrical relay 28 connected to the electric circuit of the identification elements.

The electrical relay 11 is also connected to the electrical circuit of the identification elements, relay 11 also controlling the supply of pressure medium through the electromagnetic slide valve 12 to the auxiliary hydraulic cylinders 13. These cylinders 13 adjust the position of the slidable form plates 15 according to the size number of the shoe being worked upon. The shoe last 8 is supported by its heel on the pin 9 of the heel support 10, which is brought to its working position by the setting cylinder 25, the operation of which is controlled by a command given by the machine attendant.

As above noted, distance $h_1$ of the axis of the centering bore in the heel part of the shoe last 8 from the extremity of the curve of this heel part is constant for all sizes of shoe lasts. The position of the electro-magnetic control slide valve 6 is determined by the electromagnetic control relay 7, which is controlled by the electrical circuit of the light sources 3 and photocells 2; after interruption of the light beam by the respective toe part of the right or left shoe last 8, the supply of liquid to the hydraulic control cylinder 4 is stopped, and no further movement of the identification elements takes place. Thus all working elements of the shoe stretching machine are controlled in accordance with the size number of a right or a left shoe last.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. Apparatus for identifying the size numbers of right and left shoe lasts on a shoe making machine having a frame and shoe ironing devices, comprising a support for the heel part of a shoe last supported on the frame of the machine, the support having means cooperating with the heel part of the shoe last to locate the last with respect to the support, the heel part support having an extension, a support for the toe part of the shoe last slidingly supported on the extension for movement in a direction perpendicular to the longitudinal axis of the shoe last, a support for identification elements slidably mounted on said extension for movement in the direction of the longitudinal axis of the shoe last, a first power means for selectably sliding the support for the identification elements in reverse directions, the identification elements comprising two sets of light sources and cooperating photocells arranged side by side on the support for the identification elements and adapted to identify in the course of their movement the size number of a left or a right shoe last by the interruption of a light beam striking the photocell by the toe part of the shoe last, means to control the said first power means according to the response of one of said photocells, second power means fixedly mounted on the frame of the machine, means controlling the said second power means in response to said photocells, and form plates for adjustment of said ironing devices slidably supported on the frame of the machine for movement in reverse directions generally along the length of the shoe last, the second power means being connected with said form plates so as selectively to adjust the form plates in either direction generally longitudinally of the shoe last.

2. Apparatus as claimed in claim 1, wherein the first power means comprises a hydraulic control cylinder fixed to said extension, a piston with a piston rod slidably arranged in such hydraulic control cylinder the piston rod being disposed in the direction of the longitudinal axis of the shoe last and connected to the support for identification elements.

3. Apparatus as claimed in claim 2, wherein said second power means comprises auxiliary hydraulic cylinders fixed to the frame of the machine, said apparatus further comprising electrical circuits with means controlling the hydraulic circuits of said auxiliary cylinders in response to said photocells.

4. Apparatus as claimed in claim 1, comprising means for slidingly supporting the support for the toe part of the shoe last for movement in a direction generally transverse to the longitudinal axis of the shoe last, and additional power setting means fixedly connected to the frame of the machine, means connecting the power setting means for selectively moving the spport for the toe part of the shoe last in reverse directions, and means for controlling the additional power setting means in response to said photocells.

5. Apparatus as claimed in claim 4, wherein the additional power setting means comprises a hydraulic setting cylinder fixedly attached to the frame of the machine, a piston in said cylinder, and piston rod connected to said piston, the piston rod being connected to the support for the toe part of the shoe last.

* * * * *